US005566783A

United States Patent [19]

Yamashita

[11] Patent Number: 5,566,783

[45] Date of Patent: Oct. 22, 1996

[54] VEHICLE PARKING SYSTEM

[75] Inventor: Kyoichi Yamashita, Yokohama, Japan

[73] Assignee: Koyo Jidoki Co., Ltd., Kanagawa-ken, Japan

[21] Appl. No.: 370,250

[22] Filed: Jan. 9, 1995

[30] Foreign Application Priority Data

Feb. 25, 1994 [JP] Japan ..... 6-053201

[51] Int. Cl.[6] ..... B66F 7/02

[52] U.S. Cl. ..... 187/210; 187/255; 187/266

[58] Field of Search ..... 187/251, 255, 187/266, 203, 210, 411, 412

[56] References Cited

U.S. PATENT DOCUMENTS

| | | | |
|---|---|---|---|
| 569,934 | 10/1896 | Parkinson | 187/255 |
| 2,537,075 | 1/1951 | Margles | 187/266 X |
| 3,101,130 | 8/1963 | Bianca . | |
| 3,796,285 | 3/1974 | Grebenstein | 187/255 |
| 3,968,861 | 7/1976 | Kernen | 187/255 X |
| 4,565,264 | 1/1986 | Kunii | 187/411 X |

FOREIGN PATENT DOCUMENTS

| | | | |
|---|---|---|---|
| 1454359 | 9/1966 | France | 187/203 X |
| 1506667 | 12/1967 | France | 187/210 X |
| 687243 | 1/1940 | Germany | 187/251 X |
| 2279880 | 11/1990 | Japan . | |
| 3177288 | 8/1991 | Japan | 187/266 X |
| 532384 | 2/1993 | Japan | 187/266 X |
| 616357 | 3/1946 | United Kingdom . | |

OTHER PUBLICATIONS

Contactor 'Electric Lifts: A practical Treatise on their Construction operation and maintenance', 1941, George Newnes Ltd, London.

*Primary Examiner*—William E. Terrell
*Assistant Examiner*—Dean A. Reichard
*Attorney, Agent, or Firm*—Nikaido, Marmelstein, Murray & Oram LLP

[57] ABSTRACT

An elevator system in an elevator shaft comprising a carriage movable vertically in the shaft, a counterweight suspended in the shaft on an opposite side of the carriage, upper wheels rotatably mounted at an upper end of the shaft, a suspended cable strung on the upper wheels having opposite ends, the opposite ends of the suspended cable being attached to the carriage and the counterweight respectively, a lower haulage cable strung around the lower wheels and having opposite ends, the opposite ends of lower haulage cable being joined to the carriage and the counterweight, respectively, and a driving unit operatively associated with one of the suspended cable and the lower haulage cable positioned at the bottom of the shaft.

1 Claim, 4 Drawing Sheets

VEHICLE PARKING SYSTEM

BACKGROUND OF THE INVENTION

The present invention relates to an elevator system for vertically carrying human beings or freight, and more especially to an elevator system for transporting automobiles from one floor to the designated floor in a parking tower.

FIG. 5 shows an conventional elevator system for passengers or freight. This comprises a carriage (c), wire cable (b), counterweight (d), two wheels (a) and driving unit (e), for example, a winching machine and so on which is located in an upper elevator room. The carriage is suspended on one end of cable (b) (c) and the counterweight (d) is suspended on the other end of the cable (b). The cable (b) is threaded over the wheels (a) and the driving unit (e) in the upper elevator room at the top of the shaft. This system allows human beings or freight to be carried in the carriage (c) by the driving unit (e) winding up and down the cable (b).

This described elevator system has certain disadvantages such as the following. The requirement for the driving unit comprising a large scale electric motor, a device for changing speed and a winching machine, to be located in a vertically higher position than the rest of the system makes necessary high rigged design of structures and wide occupied space for the driving unit (e). The structure of a parking tower, which must absorb the vibrations from the driving unit, allows low efficiency of vibrations in spite of the builder taking actions to prevent noises and vibrations from occurring while running the driving unit (e). Particularly, the lighter weight of materials of construction as may be used in a structure such as a parking tower, causes this problem to be greater.

Slippage between suspended cable (b), which can be wire cable or rope, and the wheels (a) can occur and may result in a lack of accuracy and/or repeatability in definite stoppage points of the carriage (c) after going up and down. In case of using a conventional elevator system for a vehicle parking system to carry automobiles, it is conceived that an elevator system such as carriage and counterweight, respectively, tied to ends of a suspended cable are vertically moved. However, as stated above, in addition to the slippage which is apt to occur between wheel and cable in the use of wire rope for cable, there are several problems such that carriage cannot hold horizontal or it is apt to go down at one end of a pair of suspended cables. It has been considered to adopt chain instead of a suspended cable (b). However, it is difficult to keep the stability of controlling elevation to be balanced between the carriage and the counterweight in such a system, because the self weight of the suspended cable or chain is added onto the weight of the carriage when carriage goes down, and the self weight of the suspended cable is added onto the weight of the counterweight when the carriage goes up.

The self weight of the suspended cable, when added onto the weight of the carriage or counterweight, is not negligible when considering how to adjust balance between the carriage and the counterweight. This is one reason which causes trouble for the driving unit in the form of excessive overload. Often it becomes necessary to use a larger sized driving source.

OBJECTS AND SUMMARY OF THE INVENTION

The object of this invention is to provide an elevator system in which it is not necessary for the driving unit to be positioned in a space in an upper elevator room.

It is a further object of this invention to provide an elevator system in which it is possible to get high efficiency of an antivibration system.

It is a further object of this invention to provide an elevator system in which it is easy to adjust the balance between the carriage and the counterweight.

It is a further object of this invention to provide an elevator system in which it is possible to reduce load applying driving unit.

It is a further object of this invention to provide an elevator system which is easily useable for a vehicle parking tower.

This invention is an elevator system in an elevator shaft comprising a carriage movable vertically in the shaft, a counterweight suspended in the shaft on an opposite side of the carriage, upper wheels rotatably mounted at an upper end of the shaft, a suspended cable strung on the upper wheels having opposite ends, the opposite ends of the suspended cable being attached to the carriage and the counterweight respectively, a lower haulage cable strung around the lower wheels and having opposite ends, the opposite ends of lower haulage cable being joined to the carriage and the counterweight, respectively, and a driving unit operatively associated with one of the suspended cable and the lower haulage cable positioned at the bottom of the shaft.

Further, this invention can comprise such a system wherein the suspended cable is wire rope, the lower haulage cable is chain and the driving unit applies lifting force to carriage via the lower haulage cable and is located at the bottom end of the elevator shaft.

And further, this invention can have both the suspended cable and lower haulage cable be chains.

In a specific embodiment, this invention can include an elevator system in an elevator shaft facing at least one parking space in a parking tower comprising a carriage movable vertically in the shaft, a counterweight suspended in the shaft on an opposite side of the carriage, upper wheels rotatably mounted at an upper end of the shaft at both sides thereof, a pair of suspended cables using wire ropes strung over the upper wheels located on both sides of elevator shaft, the carriage and the counterweight being connected to the opposite ends of each of the suspended cables, lower wheels located at a bottom end of the elevator shaft at both sides thereof, a pair of lower haulage cables using chains strung around the lower wheels and having opposite ends respectively joined to the carriage and the counterweight, and a driving unit operatively associated to rotatably drive both lower haulage cables and apply lifting force to the carriage via the lower haulage cables, the driving unit being located at the bottom end of the elevator shaft.

It can get stable lifting control to reduce the load of the driving unit in order to adjust the weight balance easily between the left and right sides of the suspended cable connecting lower haulage cables with the lower half portion of the carriage and the counterweight.

Excessive force is not applied to load the driving unit owing to inertia and constantly balance the weight of the cable between left and right portions because the different weights of suspended cable between left and right portions is to be compensated for by the use of the lower haulage cable without concern for the height of the carriage. And yet the driving force for lifting the carriage may be considered as only the weight of the carriage thereby neglecting the weight of suspended cable. So it allows not only decreased trouble with the driving unit but also a design of a minimized driving unit compared to a conventional type.

The space to be occupied for driving unit is not necessarily located in the upper end of the elevator shaft, but instead is located in the bottom of elevator shaft. Thus, there is no consideration of design to require extra structural strength of the main frame of building. In additionally, it may be easy to prevent vibrations from the driving unit when compared to locating the driving unit in the upper room of the elevator shaft.

By adopting chain for the lower haulage cable, more precise control can be obtained for the carriage to hold the stop line, this being caused by the restricted slippage between suspended cable and upper wheels.

BRIEF DESCRIPTION OF DRAWINGS

The above and other objects and the attendant advantages of the present invention will become readily apparent by reference to the following detailed description when considered in conjunction with the accompanying drawings wherein.

DETAILED DESCRIPTION OF THE PREFERRED EMBODIMENT

Figure 1:
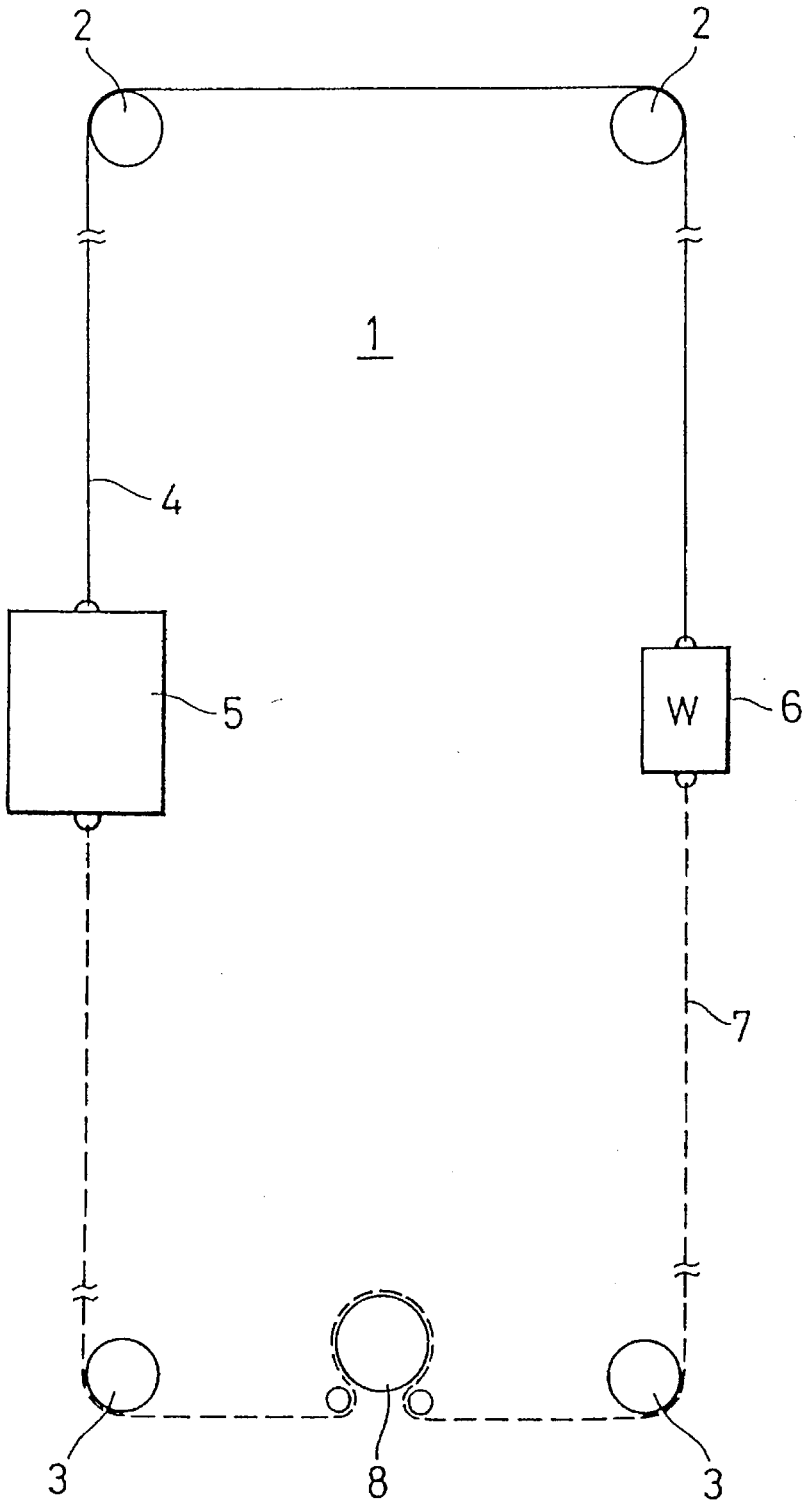
FIG. 1 shows a schematic diagram of an embodiment of the present invention with the carriage at a mid position.

FIG. 1 shows a schematic diagram of an elevator system according to the present invention. Upper wheels 2,2 and lower wheels 3,3 are located in respective upper and lower elevator rooms at opposite ends of an elevator shaft or space. Suspended cables 4 using wire ropes are strung between the upper wheels 2,2. The ends of the suspended cables 4 are connected to the carriage 5 and the counterweight 6 respectively. A lower haulage cable 7 using chains is strung between lower wheels 3,3. The ends of the lower haulage cable 7 are connected in tension to the carriage 5 and the counterweight 6, respectively. The suspended cable 4 and lower haulage cable 7 are formed into a loop with the carriage 5 and the counterweight 6 positioned in the loop in symmetric positions. Driving unit 8 for operating the system carriage is located in the bottom of elevator shaft 1. Each individual element is described below.

CARRIAGE

Carriage 5 is not always restricted to carry human beings or freight but also can be a device for delivering, for example, such as a device to transport automobiles on boarding normally lacking structures such as a multi-floored parking tower.

Carriage 5 is equipped with such as mechanisms to be contacted with guide ways (not shown) located in the longitudinal directions in the elevator shaft and to stop the system in an emergency. Other components of carriage 5 are added as needed in accordance with the aim of transporting usage.

COUNTERWEIGHT

Counterweight 6 is made of sufficiently heavy materials enough to be balanced with carriage on boarding. That is, it needs to be sufficiently heavy to counterbalance the maximum permitted weight of the carriage 5 and load therein. In determining an appropriate weight for the counterweight, the different weights between left and right sections of the suspended cables 4 with the moving up and down of the carriage 5 (or counterweight 6) may be neglected, as particularly in present invention, the weight added by both ends of the suspended cables 4 is not changed without corresponding to the vertical level of carriage 5.

LOWER HAULAGE CABLE

Lower haulage cable 7, having a series of suspended cable, is constructed of roller chain to compensate for the different weight between left and right ends of the suspended cable 4 when the carriage 5 is caused to be moved up and down and is guided around in contact with toothed lower wheels 3,3. Each end section of the lower haulage cable 7 is respectively connected with carriage 5 and the counterweight 6. Lower haulage cable 7 allows the strength of tension force to be small as compared with suspended cable for the weight of carriage and counterweight is not added directly to it. It is useful for lifting control of carriage 5, therefore there is no slippage between toothed lower wheels 3 and lower haulage cable 7 because chain is used. Additionally, as a result from this, because suspended cable 4 is in series with the lower haulage cable by the connection through the carriage and the counterweight, slippage can be prevented between suspended cable 4 and upper wheel 2.

DRIVING UNIT

The driving unit 8 applies lifting force to the carriage and to suspended cable 4 via the lower haulage cable 7 located in the bottom of the elevator shaft. This terminology, which is generally used to mean the bottom of the elevator shaft, means in this application that the driving unit 8 can be in any location lower than the very top of the shaft as long as the driving unit 8 is able to drive the lower haulage cable 7 in the elevator shaft, but it does not have to be restricted to the bottom of it.

Driving unit 8 basically is constructed as a toothed wheel contacted with haulage cable 7 using chain on the way and an electric motor driving this toothed wheel. The haulage cable may be applied with a rotational force (the haulage) by the torque of toothed wheels directly receiving the driving force of the electric motor. Other component elements of the driving unit 8 can be those as are used in a conventional elevator system such as mechanisms for mechanically changing revolution speed from the motor, electric control devices and conventional braking systems which operate in an emergency as well as gear mechanisms and driving shafts.

In conventional systems, the bottom of the elevator shaft is hardly used at all. If occupied, generally, it only contains damping materials or devices designed to absorb shock which may be caused by several kinds of falls. The locating of the driving unit 8 in the bottom of elevator shaft as in this embodiment gives not only effective usage of the bottom space in the elevator shaft but also makes it easy to prevent vibrations from driving unit 8 being transmitted to the system and for receiving vibrations on the ground so that it has a merit on the design of strength of building as compared with laying the driving unit on the top of tower.

The working of an elevator system according to the present invention will be described as follows.

STATIC CONDITION

When the system as shown in FIG. 1 has the driving unit 8 not running, that is, the system is static, the weight of carriage 5 hanging by suspended cable 4 is balanced with counterweight 6. As a whole, it is kept in balance between the weights of the left and right portions of the suspended cable so as to compensate for the different weight between left and right weights of suspended cable by itself. It will be described the compensation of weight by suspended cable later.

MOVING DOWN

Figure 2:
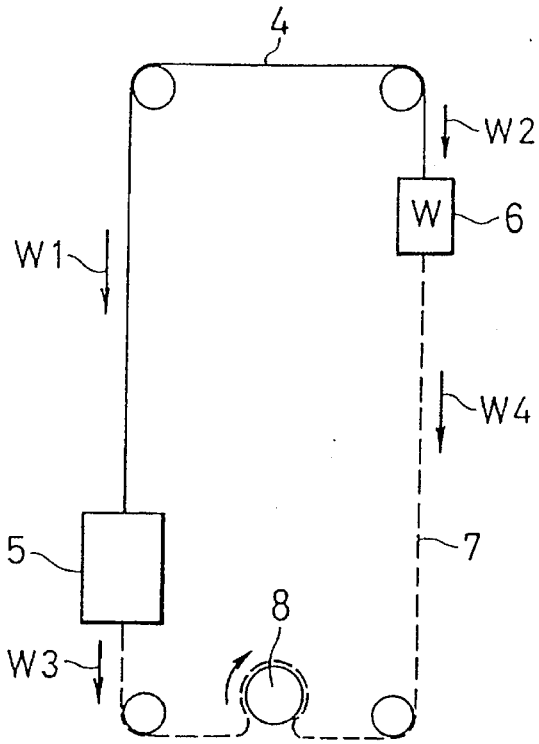
FIG. 2 shows a schematic diagram with the carriage at a down position.

FIG. 2 shows a schematic drawing while the carriage is moving down. When driving unit 8 turns in the clockwise direction, the left half side of lower haulage cable 7 provides the drawing force to pull down carriage 5. With the moving down of the carriage 5, suspended cable 4 moves toward the left half side of the drawing and the counterweight 6 and the right half side of the lower haulage cable 7 are pulled up. The moving down of the carriage 5 and moving up of the counterweight 6 makes progress at the same time accompanied since they are in series.

The balance of weight of the entire elevator system will be considered at this time. When considering only the suspended cable 4, while the self weight W1 of the suspended cable 4 joined to the carriage 5 is increasing with movement down of the carriage 5, the self weight W2 of the suspended cable 4 joined to the counterweight 6 is decreasing. A differential in weight is generated (W1–W2). However the self weight W2 of the suspended cable 4 will be compensated by increasing the self weight W4 of the lower haulage cable 7 joined to the counterweight 6, when the self weight W1 of the suspended cable 4 joined to the carriage 5 is increasing. And the self W3 of the lower haulage cable 7 joined to the carriage 5 is decreasing with its movement down.

From above description, it can be seen that the total weight of each portion of the suspended cable 4 respectively joined to the carriage 5 and the counterweight 6, and the portions of the lower haulage cable 7 is approximately balanced between left and right sides as a whole.

This is the reason that the self weight W1 of the suspended cable 4 joined to the carriage 5 added the self weight W3 of the lower haulage cable 7 is set to be approximately equal to the self weight W2 of the suspended cable 4 joined to the counterweight 6 added to the self weight W4 of the lower haulage cable 7.

MOVING UP

Figure 3:
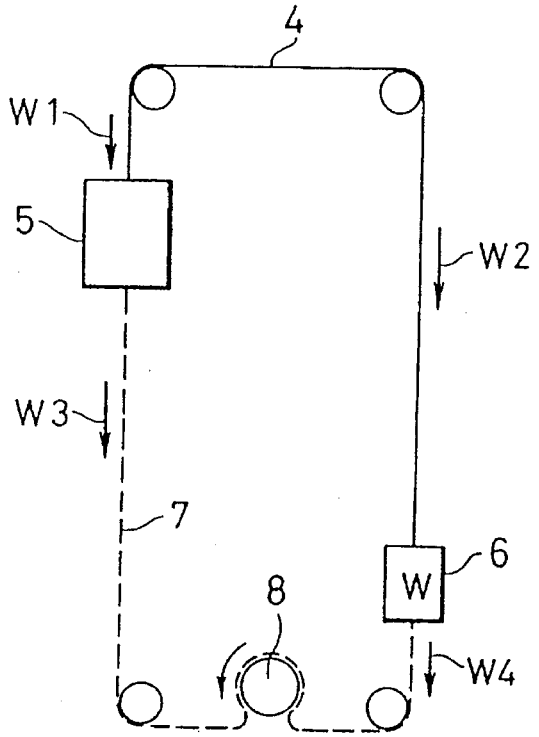
FIG. 3 shows a schematic diagram with the carriage at an up position.

FIG. 3 shows a schematic drawing, while the carriage 5 is moving up. The right side portion of the lower haulage cable 7 pulls down the counterweight 6 when the driving unit 8 turns counter-clockwise. Carriage 5 is pulled up as a result of the suspended cable 4 being pulled by the counterweight 6. The right side portion of the lower haulage cable 7 joined to the carriage 5 is pulled up with moving up of the carriage 5. The principle of controlling balance of weights between left and right sides is the same as above described in moving the carriage 5 down.

The above is described in case of a constant weight of the carriage 5. There is no problem to operate to control balance of the different weights of suspended cable by lower haulage cable 7, therefore, changed weight of carriage 5 will be taken an action of setting the weight on counterweight 6 as same as a conventional way, however, the weight 6 of carriage 5 may be changed in accordance with unloading or not.

DRIVING UNIT

The influence of inertial force needs to be considered with respect to the driving unit and, more particularly, to the required driving power of the driving unit in moving the carriage up and down. First, the influence of inertia force will be considered on the driving unit 8.

Figure 5:
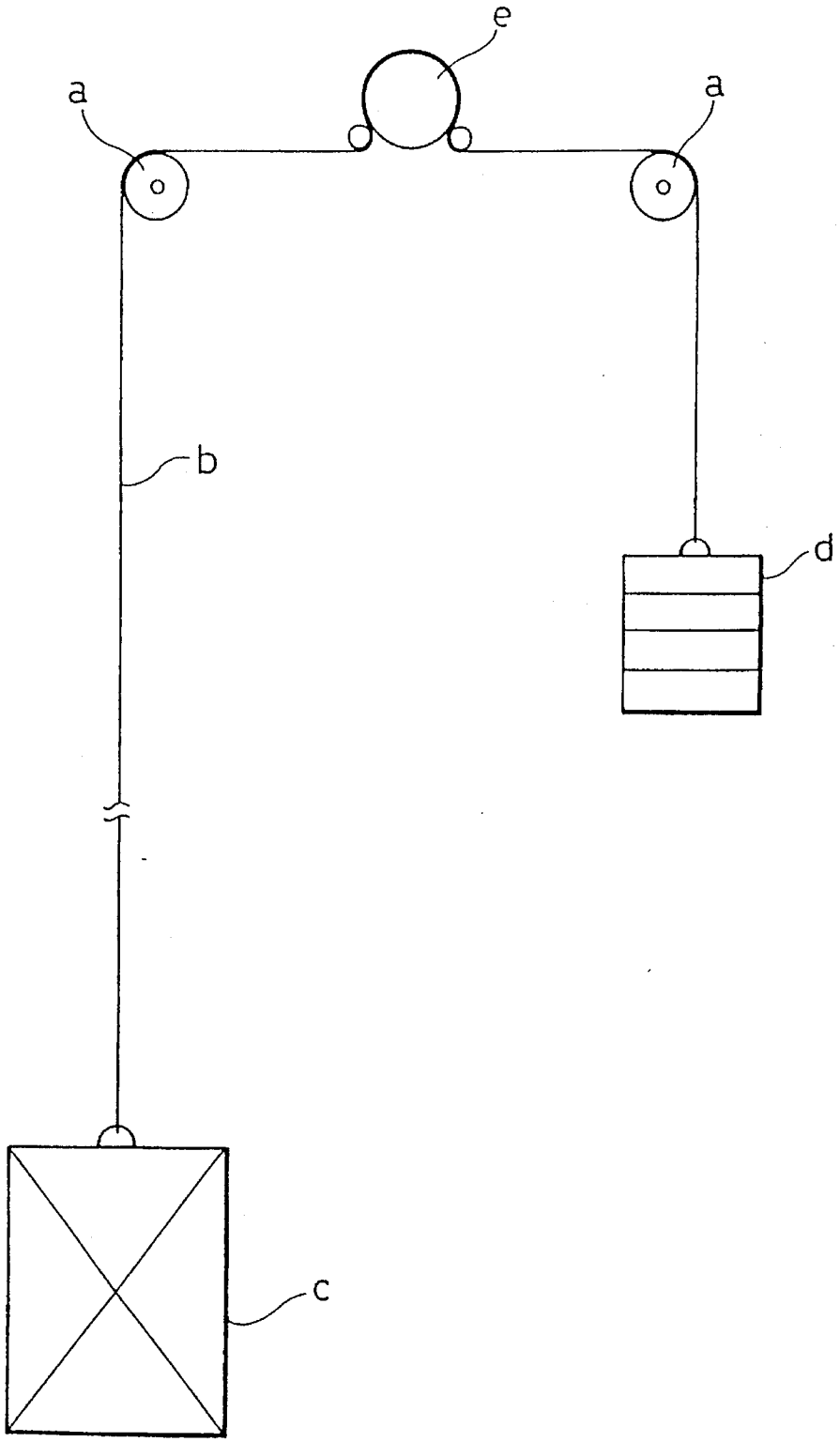
FIG. 5 shows a drawing of a conventional elevator system.

Viewing the conventional elevator system as in FIG. 5, for example, as the carriage (c) moves down, the self weight of the suspended cable (b) joined to the carriage increases. Consequently, the inertia force to be loaded on driving unit (e) at the time of stopping the carriage becomes large. In contrast thereto, with the present invention, because of the balance of weight between left side and right sides in moving up and down carriage 5 and counterweight 6, a relatively small, consistent inertia force is loaded on the driving unit 8 upon stopping the carriage 5 when compared to the conventional unit in FIG. 5.

In consideration of the required driving force in moving the carriage up and down, the driving force of the conventional driving unit as shown in FIG. 5 has to take into account the weight of carriage (c) and suspended cable (b). In contrast thereto, the required force of moving the carriage 5 up and down is only a small driving force taking into account only the weight of the carriage and neglecting the weight of suspended cable 4. Therefore, lower haulage cable 7 makes up for the weight to keep constantly balanced weight of suspended cable between left and right sides without specific consideration of the elevation position of carriage 5.

It will be also considered to give tension force on suspended cable 4 without a hanging weight in contrast to the suspended cable 4 being given tension force by using a hanging weight in the above embodiment. As a method to give such a tension force, such ideas as, for example, to tension the cable by like a jack to fix an end of suspended cable 4 joined endlessly or to tension the cable by fixing an end of lower haulage cable 7. In present example, it has a merit to get a high efficiency to prevent slippage between suspended cable 4 and upper wheel 2.

Figure 4:
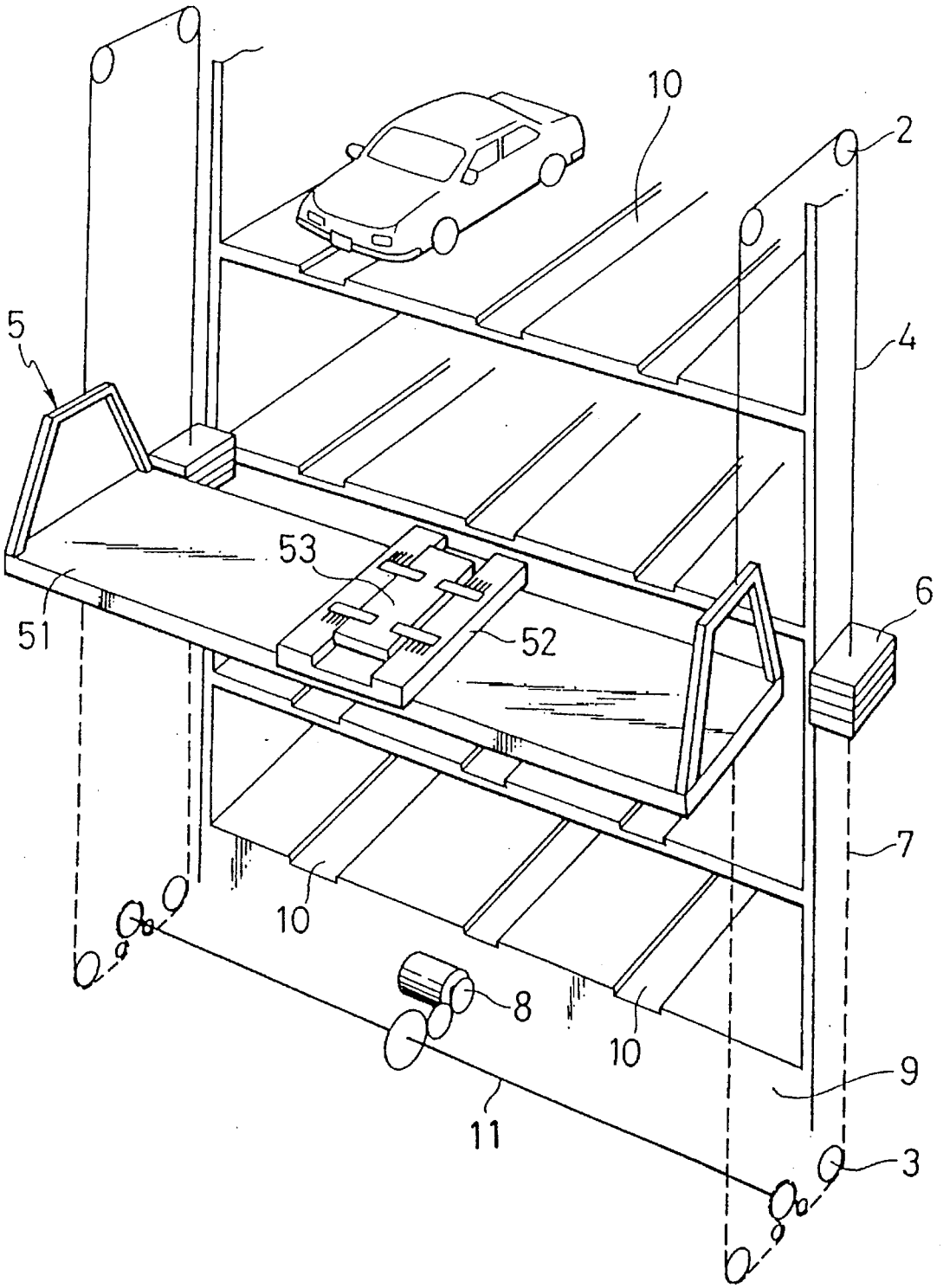
FIG. 4 shows a perspective view of a preferred embodiment of the present invention applied to an automobile parking tower.

FIG. 4 shows the example of elevator system of the present invention applied to a vehicle parking tower.

The parking tower has multiple floors and plural parking spaces. The elevator system is arranged to be freely liftable within a shaft 9 (corresponding with the elevator hall or space) facing each parking level.

Carriage 5 in such an example can comprise: an elevating carriage member 51 movable along the longitudinal axis of shaft 9; a crossing rack 52 being carried on the carriage member 51 movable in the transverse direction of the shaft 9; and, a carrier 53 being carried on the crossing rack 52 which can freely be put into and out of each parking space 10. A serial motion of raising and lowering of the elevating carriage 51, lateral movement to the left and the right of the crossing rack 52 and forward and backward movement of the carrier 53 makes it possible to transport a vehicle between a delivering point and a designated parking slot.

The specific structure of elevating carriage (that is, the crossing rack and the carrier mechanism) will be omitted because it is described in Japanese Published No. 90279880 previously applied for by the applicant.

The elevator system of the present invention comprises duplicate structures located at both sides of shaft 9, each structure have a suspended cable 4 using wire rope strung over upper wheels 2 in a space beside shaft 9 having the ends of the cable 4 connected to the elevating carriage 51 and a counterweight 6 respectively, and lower haulage cables 7 using chain riding over toothed wheels 3 and being connected at its ends to elevating carriage 51 and counterweight 6 respectively. A driving unit 8 (electric motor) and driving shafts 11 with appropriate gearing are located in a lower end of shaft 9 and transmit torque from driving unit 8 to lower haulage cables 7,7. In this case, elevating carriage 51 is prevented from tilting to the left or right, therefore, driving shafts 11 can be driven to be latched both lower haulage cable 7,7 at the same time. When applying this system to an automobile parking, it has the merits of extremely low noise by using wire rope for suspended cable 4. While slippage between upper wheels and suspended cable 4 may be of concern, the use of chain for lower haulage cable 7 can solve this difficulty. A high efficiency of preventing vibrations is obtained as compared with the conventional type, therefore, vibration from driving unit 8 can directly propagate to the ground without going through intermediate structures.

As a further alternative, chain for suspended cable 4 may be used (the same material as of lower haulage cable 7), while it is described the same as the above example in case of using wire rope for suspended cable 4.

It is readily apparent that the above-described has the advantage of wide commercial utility. It should be understood that the specific form of the invention hereinabove described is intended to be representative only, as certain modifications within the scope of these teachings will be apparent to those skilled in the art.

Accordingly, reference should be made to the following claims in determining the full scope of the invention.

I claim:

1. An elevator system in an elevator shaft facing at least one parking space in a parking tower comprising a carriage movable vertically in the shaft, a counterweight suspended in the shaft on an opposite side from said carriage, upper wheels rotatably mounted at an upper end of the shaft at both sides thereof, a pair of suspended cables using wire ropes strung over the upper wheels located on both sides of the elevator shaft and having opposite ends, said carriage and said counterweight being connected at side ends thereof to the opposite ends of each of said suspended cables, lower wheels located at a bottom end of the elevator shaft at both sides thereof, a pair of lower haulage cables using chains strung around said lower wheels and having opposite ends respectively joined to said side ends of said carriage and said counterweight, and a driving unit and driving shafts connected to said driving unit transmitting torque to rotatably drive both lower haulage cables in synchronization and apply lifting force to said carriage via said lower haulage cables, said driving unit and driving shafts being located at the bottom end of said elevator shaft.

* * * * *